United States Patent [19]

Blum

[11] Patent Number: 4,545,138

[45] Date of Patent: Oct. 8, 1985

[54] REUSABLE TYING DEVICE

[75] Inventor: Ronald D. Blum, Roanoke, Va.

[73] Assignee: Tie-Tite Products, Inc., Roanoke, Va.

[21] Appl. No.: 607,258

[22] Filed: May 4, 1984

Related U.S. Application Data

[63] Continuation-in-part of Ser. No. 552,382, Nov. 16, 1983, abandoned.

[51] Int. Cl.[4] ..... A43B 11/00; F16G 11/00

[52] U.S. Cl. ..... 36/51; 36/50; 24/119; 24/117

[58] Field of Search ..... 36/50, 51, 54; 24/117, 24/118, 119, 120, 121, 122, 122.6, 128

[56] References Cited

U.S. PATENT DOCUMENTS

| | | | |
|---|---|---|---|
| 303,549 | 8/1884 | Snyder | 24/120 |
| 500,497 | 6/1893 | Hathaway | 24/120 |
| 528,464 | 10/1894 | Graig | 24/119 |
| 647,824 | 4/1900 | Girtanner | 24/117 |
| 878,129 | 2/1908 | Downer | 24/120 |
| 879,272 | 2/1908 | Key | 24/119 |
| 886,792 | 5/1908 | Gayton | 24/121 |
| 1,055,048 | 3/1913 | Kennedy | 24/120 |
| 1,460,743 | 7/1923 | Binns et al. | 24/119 |
| 1,913,102 | 6/1933 | Berger | 24/117 |
| 2,035,174 | 3/1936 | McIlhenny | 24/119 |
| 2,324,962 | 7/1943 | Storey | 24/121 |
| 3,931,686 | 1/1976 | Rathbun | 36/51 |
| 4,428,101 | 1/1984 | Harkavy | 24/117 |
| 4,485,529 | 12/1984 | Blum | 24/128 |

*Primary Examiner*—Henry S. Jaudon
*Assistant Examiner*—Steven N. Meyers
*Attorney, Agent, or Firm*—Lalos, Leeds, Keegan, Marsh, Bentzen & Kaye

[57] ABSTRACT

The invention disclosed relates to an improvement for tying devices which are secured to shoes for holding the shoelace knot in place. In the embodiment disclosed, the invention incorporates elastic means for engaging the shoelace knot from opposed sides to impede the knot from becoming untied while simultaneously exposing the knot for view and maintaining the normal appearance of the bow.

26 Claims, 12 Drawing Figures

FIG. 4.
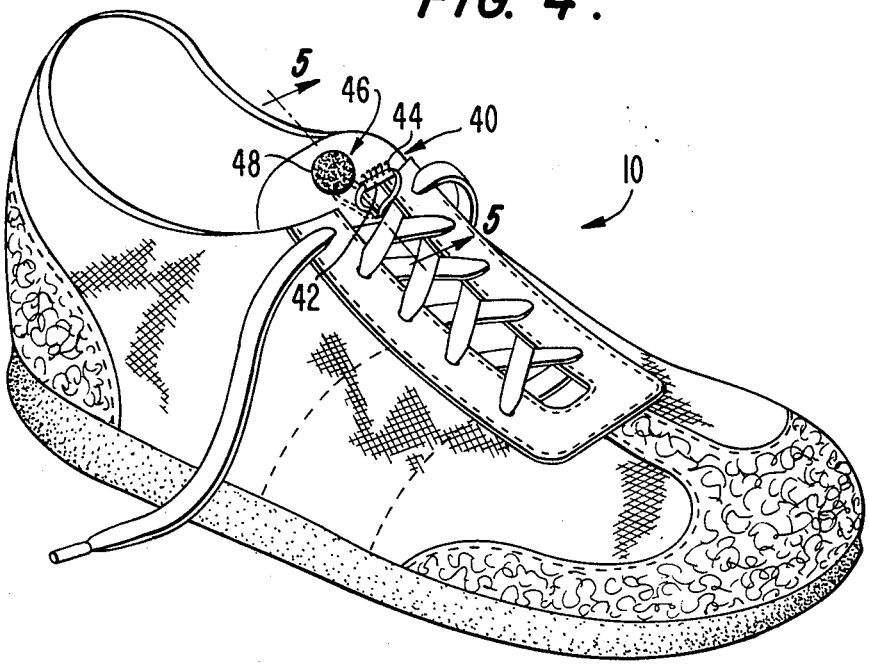
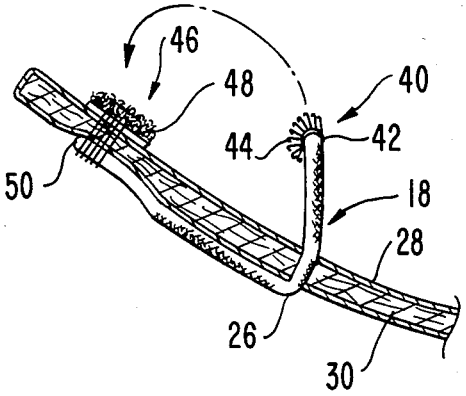
FIG. 5.
FIG. 6.
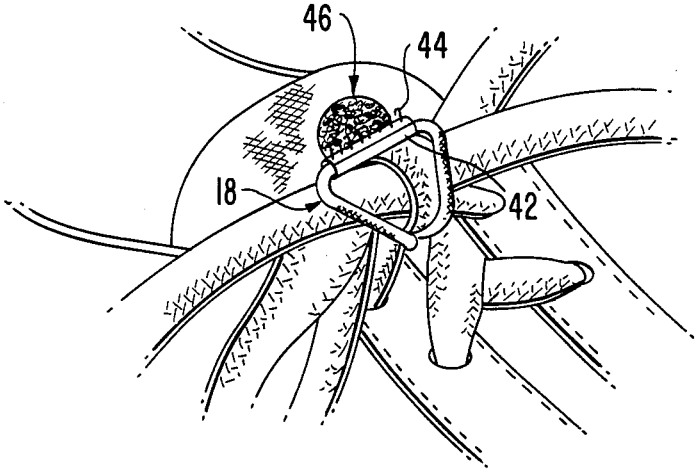

REUSABLE TYING DEVICE

This application is a continuation-in-part of Ser. No. 552,382, filed Nov. 16, 1983, now abandoned.

BACKGROUND AND DISCUSSION OF THE INVENTION

A well known problem with shoe laces, other types of laces and similar items which are tied together is that they may often become untied requiring the wearer to stop whatever activity he or she is pursuing and to re-tie the shoe laces to a satisfactory position. Particularly with respect to children and their play activities, this places a burden on their parents and other adults around them. Sports activities can virtually stop play altogether or require a player to be removed from a game until has laces are properly tied. In other sports loose or untied shoe laces may cause an athlete to lose his concentration and adversely affect performance. The form of attachment to the shoe laces should make the tying device relatively easy to secure to the shoe while exposing the knot in a manner which is acceptable to the purchasing public. Although tying devices have been used before and have been discussed in my previous applications, U.S. application Ser. No. 521,942, filed Aug. 10th, 1983, these typically involve devices which are actually removable from the shoe. Although these tying devices are advantageous, for some purchasers it is more desirable to have a tying device which at least in part is permanently secured to the shoe and is reasonably unobtrusive. The invention described herein overcomes some of the deficiencies discussed above and fills a need in the marketplace.

The above has been a brief discussion of certain deficiencies which have existed in tying devices and features of an invention which have overcome these deficiencies. Other advantages of the invention will be apparent from the detailed description of the preferred embodiment which follows.

BRIEF DESCRIPTION OF THE DRAWINGS

FIG. 4 is a perspective view of another embodiment of a shoe employing tying device of the invention.

FIG. 5 is a partial cross-section view taken along lines 5—5 of FIG. 4.

FIG. 6 is a large perspective view showing the tying device in a closed position secured about the knot formed by tied shoe laces.

DETAILED DESCRIPTION OF THE PREFERRED EMBODIMENT

Figure 1:
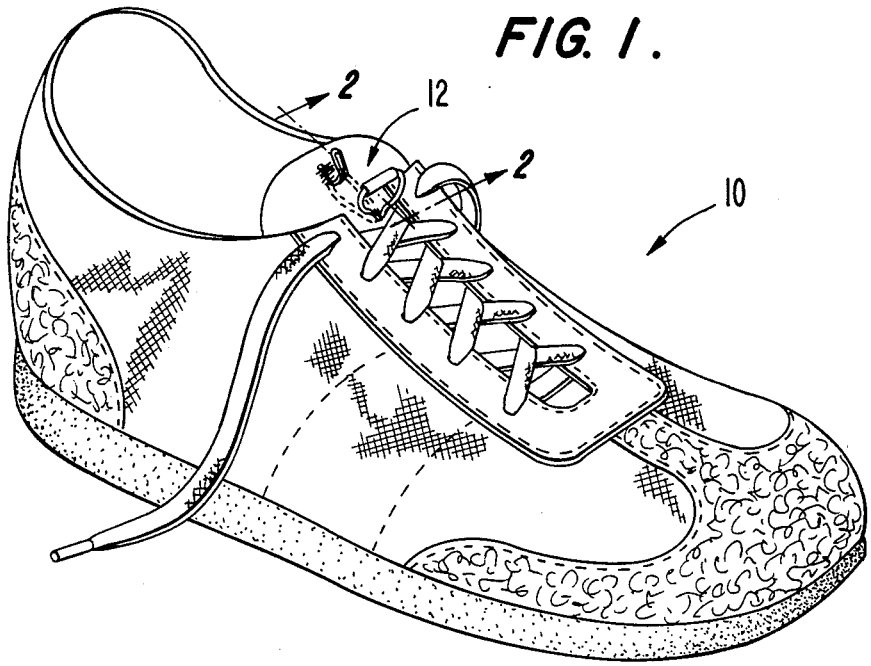
FIG. 1 is a perspective view of a preferred embodiment of a shoe employing a tying device of the invention.
Figure 2:
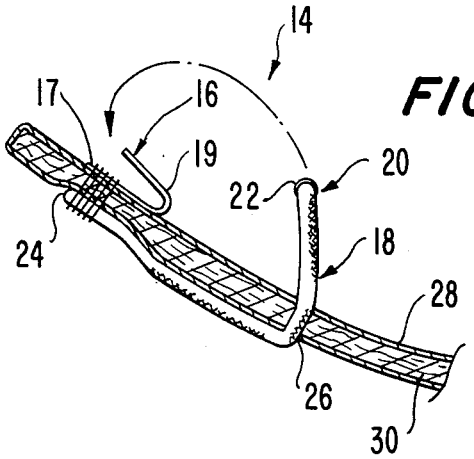
FIG. 2 is a partial cross-section view taken along lines 2—2 of FIG. 1.
Figure 3:
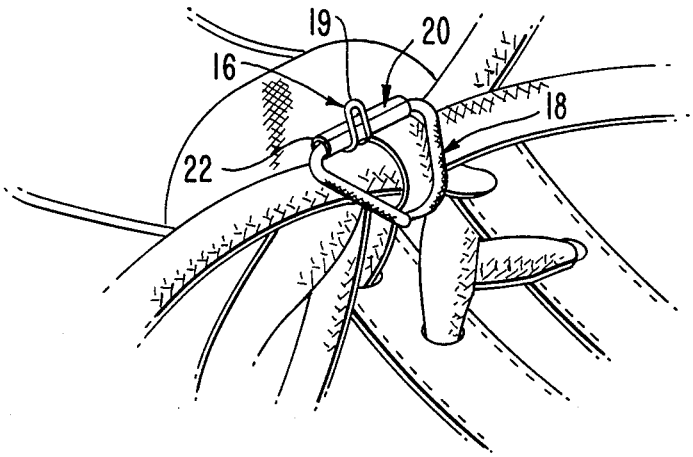
FIG. 3 is a large perspective view showing the tying device in a closed position secured about the knot formed by tied shoe laces.

As can be seen from FIGS. 1, 2, and 3 the device or tying mechanism 14 is actually secured to tongue 12 of shoe 10. the tying device includes a hook member 16 having a shank end 17 and a distal hook end 19 for receiving a portion of an elastic band. Shank end 17 is secured to tongue 12 just above the area of where the shoe laces are normally tied. Hook 16 in the preferred embodiment is simply sewn to the tongue at the position shown, however, other securing means may be employed so long as it does not interfere with the operation of the hook end 19.

Displaced from beneath hook 16 is a slot 26 cut into the tongue 12 at a position where the laces can be tied into a knot between slot 26 and hook 16. Extending through slot 26 is an elastic band 18 having a distal end 20 for cooperating with hook 16 and a fixed end 24 which is fixed to the rear surface 30 of tongue 12. As shown in the preferred embodiment of FIG. 2 the fixed end 24 is sewn through the tongue 12 opposite shank 17 of hook 16. The distal end 20 of elastic band 18 carries a metal sleeve 22 for cooperating with hook end 19. The elastic band has dimensions such that it can be stretched sufficiently to engage both sides of a shoe lace knot from either side thereof when hooked into the hook 16 as shown in FIG. 3. At this position the knot will be retained in place until the laces are untied by the user.

In operation the shoe laces are tied in a knot as they normally would be with the user insuring that the knot as tied falls between the hook 16 and the slot 26 such that the distal end or exposed portion of the elastic band 18 falls beneath the knot. Once the knot is tied, the elastic band is pulled over the knot into a position where the sleeve falls between the hook end 19 and the shank 17.

The force of the elastic band then retracts the sleeve in place to maintain the elastic band within hook 16 and secured about the knot of the shoe laces. In this position the knot will remain tied until the user removes the elastic band from hook 16. The elastic band members are maintained in a tension about the knot and grasp the knot from opposed sides to hold the knot in place. The knot with this configuration for the most part is exposed for view and has an appearance which is acceptable to the purchasing public.

Another embodiment is shown in FIGS. 4 through 6 where it can be seen that a device similar to that shown in FIGS. 1 through 3 is employed utilizing a hook and loop type separable fastener in lieu of the hook and sleeve mechanism. As many elements are substantially identical in both embodiments, only those elements which are different will be discussed in detail with respect to the second embodiment.

The device in FIGS. 4 through 6 includes a separable fastener of the hook and loop type where one part includes loop material and a complementary part includes hook material. These parts interengage and are prevented from becoming disengaged until they are peeled apart by the user. As shown, a loop member pad 46 is secured to the front face 28 of the tongue. A complimentary hook portion 40 is secured to sleeve 42 at the distal end of elastic band 18. In this manner, once elastic band 18 is pulled over the lace knot as shown in FIG. 6, the hook members 44 interengage with the pile 48 to secure elastic band 18 in place about the knot with portions of the band engaging the knot from either side to prevent it from becoming untied. To disengage elastic band 18, sleeve 42 is simply peeled away from the loop member pad 46.

The operation of this second embodiment is substantially identical to that described in the first except, of course, to secure the elastic band over the knot, the complementary hook portion is simply pressed in the loop member pad 46.

Figure 7:
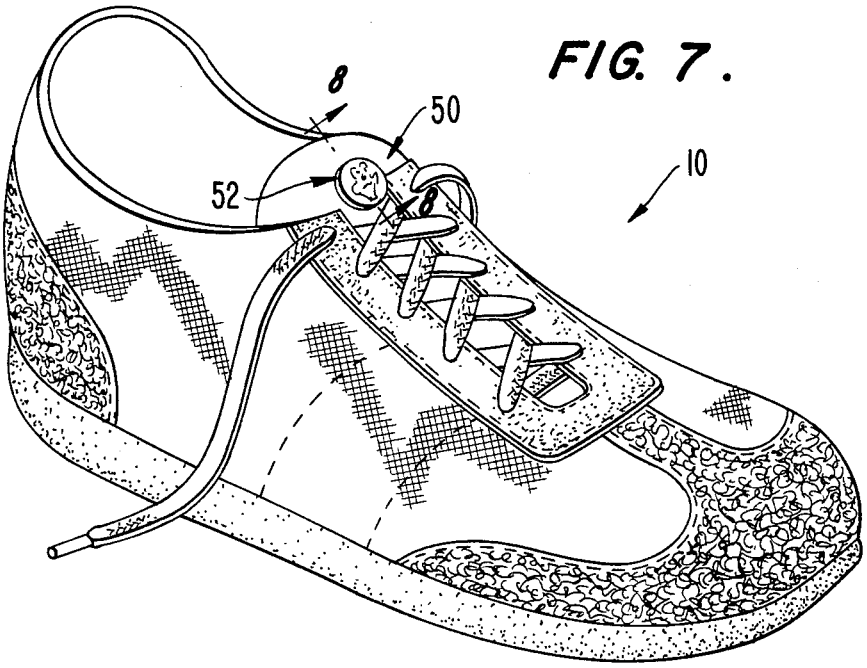
FIG. 7 is a perspective view showing another embodiment of a tying device of the invention.
Figure 8:
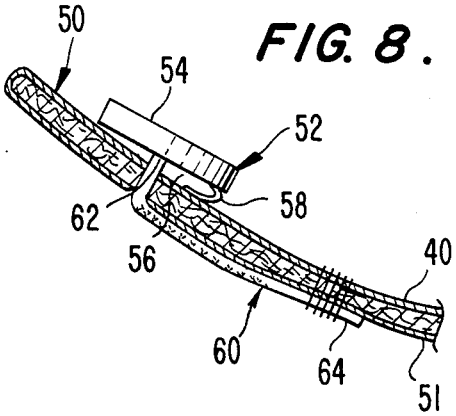
FIG. 8 is an enlarged cross-section view of the device as shown in FIG. 6 taken along lines 7—7.
Figure 9:
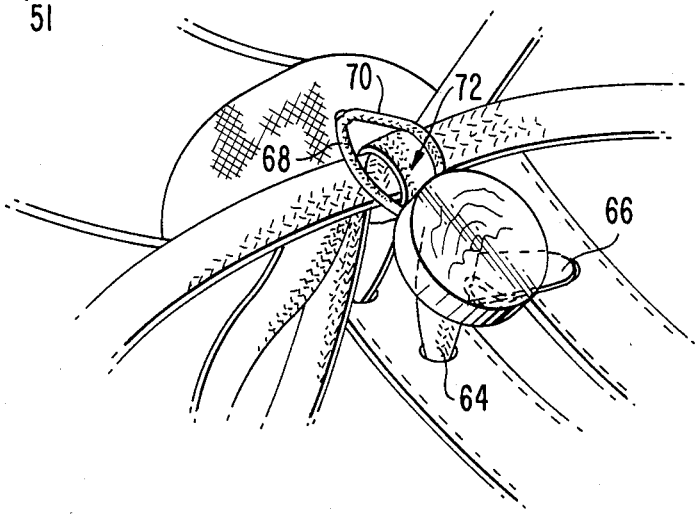
FIG. 9 is an enlarged perspective view of the tying device of the invention shown in a closed position secured about the knot formed by tied shoe laces.

A third embodiment is shown in FIGS. 7, 8, and 9. In this embodiment there is shown a securing means somewhat reversed from what is described above. Rather than having a hook affixed to the tongue, it is affixed to a medallion which is in turn secured to the elastic band permitting the medallion with the hook to be moved over the knot to secure the knot in place.

More specifically, as can be seen from FIGS. 7 and 8, the shoe 10 includes a tongue 50 having a front face 40 and a rear face 51. An elastic band 60 has a distal end 64 secured to the rear surface 51 of tongue 50 with a proximate end 62 extending through an orifice extending entirely through both the front and rear surfaces of tongue 50. The proximate end 62 of elastic band 60 is attached to a medallion 52 which serves as a support member for a pictorial work as can be seen in FIGS. 7 and 9. More specifically the support member or medallion also carries on its rear surface 56 a hook 58. In this embodiment the hook of 58 is adjacent an edge of the medallion but totally covered thereby to prevent its view from the public. In this way when the device is placed in a closed or locking position over shoe lace knot it is entirely hidden from view. In this preferred embodiment the distal end 62 is secured to the center of a generally circular support member 52 having a pictorial work 54 on its front surface. The distal end 64 and the orifice 63 are displaced from one another to provide for the tying of a shoe lace knot 72 between them as shown in FIG. 9. Once the shoe lace knot is tied the support member or medallion 52 is drawn over the shoe lace knot and the hook hooked on crossed or laced shoe laces 64 and 66. In this position the legs 68 and 70 of elastic band 60 grasp the knot on opposed side to hold the knot in place. The medallion of 52 in this locked position is shown beneath the knot secured to the shoe laces for a pleasing appearance.

Figure 10:
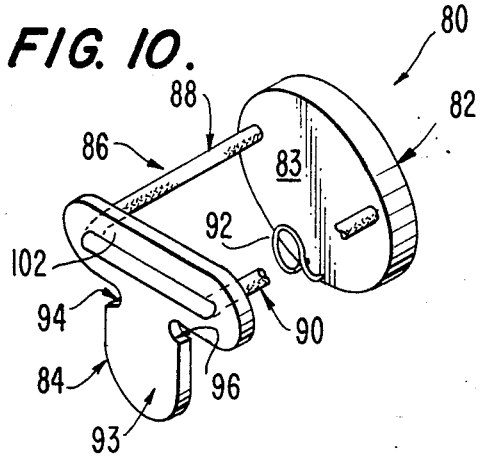
FIG. 10 is a perspective view showing a fourth embodiment of the invention.
Figure 11:
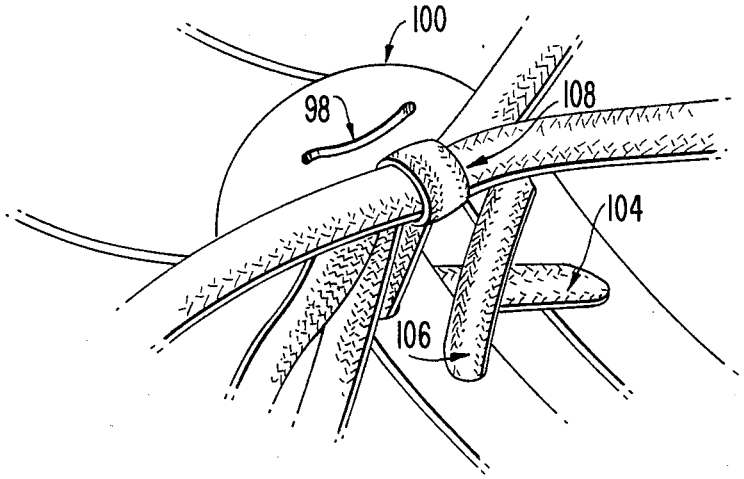
FIG. 11 is a perspective view of a portion of a shoe in the vicinity of a knot.
Figure 12:
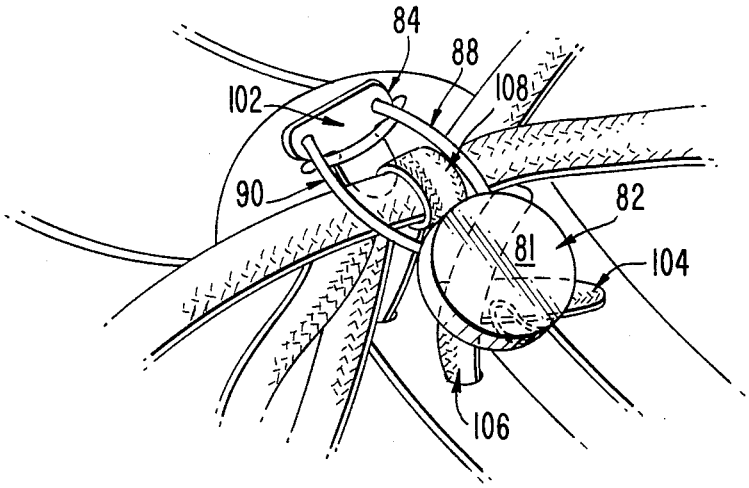
FIG. 12 is a perspective view of the shoe shown in FIG. 11 with fourth embodiment of the invention secured in place.

A fourth embodiment is shown in FIGS. 10, 11, and 12 where the reusable device encorporates part of the shoe but is also separable from the shoe for replacement when desired. The device 80 includes a medallion 82 having a front face 81 and a rear face 83. An elastic band 86 connects a medallion 82 to an attaching plate 84 which is T-shaped in configuration. As can be seen from FIG. 10, the elastic band 86 has two legs 88 and 90 which are maintained in a spaced apart configuration. On the rear face 83 of medallion 80 there is a hook 92 which enables the medallion to be hooked or secured in place beneath the knot 108 of tied shoe laces can be seen in FIG. 12. The hooking in place is similar to that of other embodiments described above and will not be discussed in detail here.

A complimentary securing means is included in the tongue of the shoe for cooperating with attaching plate 84. Specifically, a loop 98 is secured to tongue 100 of the shoe at a position above the knot 108 as shown in FIG. 11. The attaching plate 84 is T-shaped and includes a leg member 93 extending as shown downwardly from the center of a cross member 102. Two notches 94 and 96 are formed in leg member 93 adjacent the cross member 102 for engaging the edges of loop 98 where they are secured to the tongue 100.

In operation, the leg member 93 is inserted through the loop member 98 between it and the tongue 100 until the notches engage the edges of the loop as shown in FIG. 12. It is preferred that the attaching plate 84 be made of a flexible plastic material. In this manner to permit the leg member to be inserted into the loop as described, it can be slightly deformed and spring naturally into a position where the notches will engage the loop and prevent the member from being withdrawn until it is desired to do so by the user. Once in place, as shown in FIG. 12, the medallion can be grasped and pulled over the knot 108 to a position where the hook 92 secured to the laces 104 and 106 beneath the knot 108. Because of the disposition of the legs 90 and 88 of the elastic band 86, they will always be in a position such that when stretched over the knot they will engage the knot from opposed sides to hold it in position.

The above are specific embodiments of applicant's invention. It should be understood that other attaching means and hook members can be utilized and come within the scope of the invention. In any event the invention as defined in the claims which follow is intended to include variations and equivalents.

What is claimed is:

1. A shoe with a tongue and laces comprising:

(a) a hook member and an elastic band;

(b) said tongue having a front face and a rear face;

(c) said tongue having an orifice entirely through the front and rear faces;

(d) said elastic band having a distal end fixed to the rear face of said tongue, and said orifice displaced from a position on the rear face where the distal end is fixed thereto;

(e) said elastic band including a proximate end for extending through said orifice;

(f) a support member, said proximate end being attached to a rear surface of said support member; and (g) a hook member secured to said support member for interengagement with shoe laces beneath the knot of tied shoe laces, said elastic band being sufficiently elastic to permit the elastic band to be pulled over the knot and the hook secured to overlap shoe laces beneath the knot.

2. The shoe according to claim 1 wherein said hook member is secured to the rear surface of said support member.

3. The shoe according to claim 2 wherein no portion of said hook member extends beyond the periphery of said support member.

4. The shoe according to claim 3 wherein said distal end of said elastic band is sewn to the rear surface of said tongue.

5. The shoe according to claim 4 wherein said support member is dish shaped having a front surface, said front surface supporting a pictorial work.

6. A shoe with a tongue and lace as comprising:

an elastic band having a distal end and a proximate end, said distal end being secured to means for securing said band to the tongue of a shoe above the position where shoe laces are normally tied; said proximal end of said elastic band being secured to a medallion, said medallion having a surface for portraying a pictorial work; and means for releasably securing said proximate end to a portion of the shoe to permit extension of the elastic band about the knot of tied laces.

7. The shoe according to claim 6 wherein said means for removably securing said proximate end to a portion of the shoe includes a hook for engaging the shoe laces in the vicinity of the knot.

8. The shoe according to claim 7 wherein said medallion has a front face and a rear face, said front face including said surface for portraying a pictorial work, said rear face supporting said hook.

9. The shoe according to claim 8 wherein said elastic band includes two legs spaced apart for engaging the knot of a shoe lace from opposed sides.

10. The shoe according to claim 9 wherein said means for securing said band to said tongue of a shoe above the position where the shoe laces are normally tied includes a loop secured to the tongue, and loop engaging means secured to the distal end of the said elastic band.

11. The shoe according to claim 10 wherein said loop engaging means includes a leg member for sliding between said loop and said tongue of said shoe and a cross member extending from the center of said leg member and carrying said elastic band with the legs and space disposition.

12. The shoe according to claim 11 wherein said leg member has a width equal to or less than the width of said loop, said cross member being greater than the width of said loop, said leg member having notches on each side thereof to engage said loop and hold the loop engaging means in place until the form removed when desired by the user.

13. A shoe with a tongue and laces comprising:

a. a flexible band member;

b. said tongue having a front face and a rear face;

c. securing means for securing said flexible band member to at least one face of said front and rear faces of said tongue in the vicinity of the shoelace knot;

d. said flexible band member having a distal end and a proximate end, said proximate end being fixed to said securing means, said distal end having a first portion of an engaging means;

e. a second complementary portion of said engaging means for releasable interengagement with said first portion, said second complementary portion of said engaging means being fixed at least to one of said faces of said tongue;

f. said band member being movable between an unfastened and a fastened position, said second complementary portion of said engaging means being located at a position opposite from said distal end of said band in said unfastened position; and g. said band member configured to extend over a tied knot of said laces to permit interengagement of said first and second portions of said engaging means in a fastened position and to grasp the knot from opposed sides with sufficient tension to impede the knot from becoming untied.

14. The shoe according to claim 13 wherein said means for securing said flexible band member to said tongue includes means for fixedly securing the band member thereto.

15. The shoe according to claim 13 wherein said second complementary portion of said engaging means is secured to said tongue at a position adjacent to the proximate end of said band member.

16. The shoe according to claim 15 wherein said second complementary portion of said engaging means extends substantially entirely from said front face of said tongue.

17. The shoe according to claim 16 wherein said band is formed substantially of elastic material.

18. The shoe according to claim 13 wherein a substantially major portion of said band member and said engaging means consist essentially of flexible material.

19. The shoe according to claim 13 wherein said second complementary portion of said engaging is fixed to said securing means for securing said band member to at least one of said front and rear faces of said tongue.

20. The shoe according to claim 13 wherein said second complementary portion of said engaging means includes a hook member fixed to the front face of said tongue.

21. The shoe according to claim 20 wherein said distal end of said band further comprises a metal sleeve circumscribing the band, said metal sleeve configured and located to engage the hook.

22. The shoe according to claim 20 wherein the securing means for securing said flexible band member secures said band member to the rear face of said tongue at a position substantially opposed to said hook member, said tongue defining a slot extending entirely through the front and rear faces of said tongue, said slot being displaced from said hook member sufficiently to permit a knot to be tied therebetween, and said band member being arranged for extending through said slot for engagement with said hook member.

23. The shoe according to claim 13 wherein said engaging means is a separable fastener of a hook and loop type.

24. The shoe according to claim 23 wherein said tongue defines a slot extending entirely through the front and rear surfaces of said tongue wherein said securing means secures said band member to said rear surface of said tongue and said distal end of said band member as arranged for extending through said slot, said band member configured to extend over the tied knot of laces to permit inter engagement of said first and second portions of said separable fastener; and wherein said securing means secures said flexible band member to the rear surface of said tongue at a position substantially opposed to said one part of said separable fastener fixed to the front face of said tongue.

25. The shoe according to claim 24 wherein said distal end of said band member further comprises a metal sleeve circumscribing the band, said metal sleeve carrying said first portion of said separable fastener.

26. The shoe according to claim 25 wherein said complementary second portion of said separable fastener and said band member are fixed to said tongue by being sewn thereto.

* * * * *